US008060006B2

(12) United States Patent
Hensley

(10) Patent No.: US 8,060,006 B2
(45) Date of Patent: Nov. 15, 2011

(54) COUNTER-INTELLIGENCE SIGNAL ENABLED COMMUNICATION DEVICE

(75) Inventor: Marion P. Hensley, Pendleton, IN (US)

(73) Assignee: Raytheon Company, Waltham, MA (US)

( * ) Notice: Subject to any disclaimer, the term of this patent is extended or adjusted under 35 U.S.C. 154(b) by 790 days.

(21) Appl. No.: 12/174,495

(22) Filed: Jul. 16, 2008

(65) Prior Publication Data

US 2010/0015910 A1 Jan. 21, 2010

(51) Int. Cl.
*H04K 3/00* (2006.01)

(52) U.S. Cl. ..... 455/1; 455/63.1; 455/114.2

(58) Field of Classification Search ..... 455/1, 63.1, 455/501, 114.2, 296; 375/319.13, 350, 260, 375/133, 135, 229–233
See application file for complete search history.

(56) References Cited

U.S. PATENT DOCUMENTS

| | | | | |
|---|---|---|---|---|
| 6,914,950 | B1 | 7/2005 | Luneau | 375/347 |
| 7,003,332 | B2 | 2/2006 | Linn | 455/574 |
| 7,043,023 | B2 | 5/2006 | Watanabe et al. | 380/270 |
| 7,151,925 | B2 | 12/2006 | Ting et al. | 455/418 |
| 7,864,835 | B2 * | 1/2011 | Furman et al. | 375/232 |
| 2008/0043861 | A1 * | 2/2008 | Moffatt | 375/260 |
| 2008/0074322 | A1 * | 3/2008 | Ryba | 342/386 |
| 2009/0103720 | A1 * | 4/2009 | Karayil Thekkoott Narayanan | 380/34 |

* cited by examiner

*Primary Examiner* — Sujatha Sharma
(74) *Attorney, Agent, or Firm* — Baker Botts L.L.P.

(57) ABSTRACT

According to one embodiment, a radio has a memory for the storage of a number of records. Each record has a number of operating parameters that are used by a controller subsystem to control the radio's operation. The controller subsystem is operable to communicate with a first communication device using a first electro-magnetic signal while communicating with a second communication device using a second electro-magnetic signal configured according to one of the records. The first electro-magnetic signal uses a portion of the information transfer capacity of the radio and is devoid of a counter-intelligence signal. The second electro-magnetic signal comprises a counter-intelligence signal that is operable to eavesdrop or disrupt communication of the second communication device.

20 Claims, 2 Drawing Sheets

COUNTER-INTELLIGENCE SIGNAL ENABLED COMMUNICATION DEVICE

TECHNICAL FIELD OF THE DISCLOSURE

This disclosure generally relates to communication devices, and more particularly, to a communication device that transmits or receives counter-intelligence signals concurrently with other communication signals.

BACKGROUND OF THE DISCLOSURE

Radios communicate with one another using electro-magnetic signals. Electro-magnetic signals transmitted by a radio may include information modulated onto a carrier signal, which is subsequently emanated as electromagnetic radiation through an antenna. Another radio may receive the carrier signal through its antenna and demodulate the carrier signal to receive the information. Software-based radios or software defined radios enhance the versatility of conventional radios by implementing a portion of the radio's functional components with reconfigurable digital logic. In this manner, various operating parameters of electro-magnetic signals transmitted or received may be reconfigured or changed on an as-needed basis.

SUMMARY OF THE DISCLOSURE

According to one embodiment, a radio has a memory for the storage of a number of records. Each record has a number of operating parameters that are used by a controller subsystem to control the radio's operation. The controller subsystem is operable to communicate with a first communication device using a first electro-magnetic signal while communicating with a second communication device using a second electro-magnetic signal configured according to one of the records. The first electro-magnetic signal uses a portion of the information transfer capacity of the radio and is devoid of a counter-intelligence signal. The second electro-magnetic signal comprises a counter-intelligence signal that is operable to eavesdrop or disrupt communication of the second communication device.

Particular embodiments of the present disclosure may exhibit some, none, or all of the following technical advantages. For example, a radio, such as a software defined radio may implement one or more counter-intelligence signals using its unused information transfer capacity. The software defined radio may use records stored in a memory to reconfigure its operation for any of a number of counter-intelligence scenarios. In a particular scenario, the software defined radio may be configured to counter a particular threat in which a number of wireless telephones operating on a particular network have been recently purchased by known terrorist suspects. The software defined radio may be programmed to communicate counter-intelligence signals with these wireless telephones. The software defined radio, therefore, may provide communication with others while concurrently thwarting communication of known terrorist suspects within its general vicinity.

Other technical advantages will be readily apparent to one skilled in the art from the following figures, description, and claims.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

Software defined radios generally refer to radios whose operating parameters may be modified using digital logic circuitry. The digital logic circuitry may provide relatively good versatility. For example, software defined radios may be configured to modify the modulation type, message format, transmission system, or carrier frequency of transmitted or received electromagnetic signals in a relatively easy and efficient manner.

The U.S. Department of Defense (DoD) has developed the Joint Tactical Radio System (JTRS) to provide an interoperable communication platform for military personnel. Software defined radios implemented according to the JTRS standard may provide voice, data, and/or video communication services among the various branches of the military service. Software defined radios compliant with the JTRS standard may interoperate with military radios and non-military radios. In many cases, communication with others using radios operating on non-military frequency bands may be useful.

Figure 1:
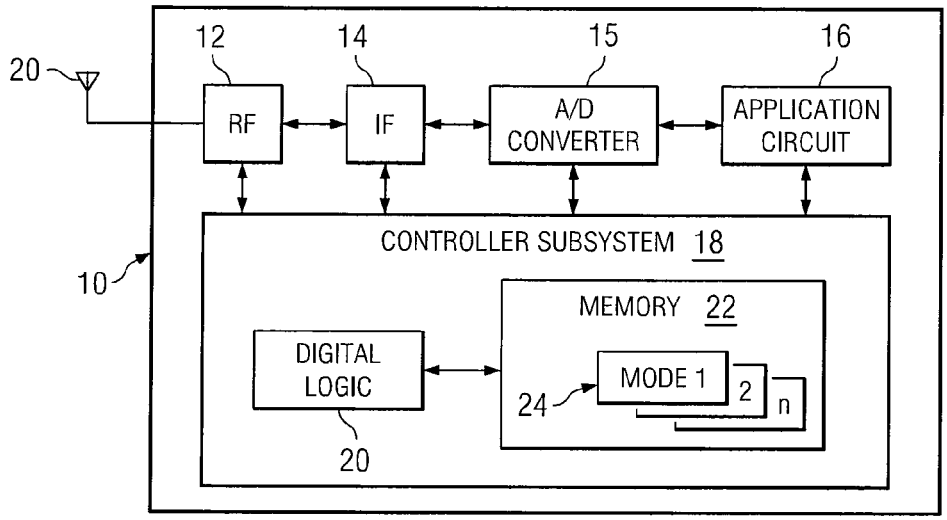
FIG. 1 is a block diagram showing one embodiment of a communication device according to the teachings of the present disclosure.

FIG. 1 shows one embodiment of a software defined radio 10 according to the teachings of the present disclosure. Software defined radio 10 includes a radio-frequency (RF) front end 12, an intermediate-frequency (IF) circuit 14, an analog to digital (A/D) converter 15, an application circuit 16, a controller subsystem 18, and an antenna 22 coupled together as shown. Controller subsystem 18 includes digital logic 20 for controlling operation of radio-frequency front end 12, intermediate-frequency circuit 14, analog to digital converter 15, and/or application circuit 16. As will be described below, controller subsystem 18 may control software defined radio 10 to provide communication with one or more communication devices while performing one or more counter-intelligence techniques using counter-intelligence signals.

Counter-intelligence signals may include any suitable radio-based approach for compromising the communication of certain radios. One objective of military personnel may be to subdue enemy forces. One approach for accomplishing this goal may be to hinder the enemy's ability to communicate with one another. Radio jamming is one particular counter-intelligence signal that may be used to hinder communication among enemy forces. Thus in one embodiment, software defined radio 10 may transmit a jamming signal during its operation. For example, software defined radio 10 may transmit an overpowering signal at certain carrier frequencies in which enemy radios operate. The overpowering signal may be received by the enemy's radio with sufficient intensity to degrade the ability of the enemy's radio to receive intelligible signals. As another example, software defined radio 10 may use a counter-intelligence signal referred to as a spoofing signal in which invalid information is transmitted to enemy radios. The invalid information may be any knowingly false information that is intended to confuse its recipient. For example, a spoofing signal may include incorrect location information of certain military armament and/or forces. In another embodiment, software defined radio 10 may use a counter-intelligence signal known as an eavesdropping signal. The eavesdropping signal is a particular type of counter-intelligence signal in which users may receive otherwise private information from others. Implementation of various counter-intelligence signals on software defined radio 10 will be described below.

Radio-frequency front end 12 is coupled between antenna 22 and intermediate-frequency circuit 14 for receiving carrier signals from antenna 22 and/or generating carrier signals that are transmitted from antenna 22. Intermediate-frequency circuit 14 may be included to convert or mix signals from application circuit 16 to an intermediate-frequency. Analog to Digital converter 15 is optional and may be included to convert digital signals originating from application circuit 16 to analog signals suitable for use by intermediate-frequency circuit 14. Application circuit 16 may be any suitable circuit that provides a communication service to the user. For example, application circuit 16 may include a microphone and/or speaker for transmitting and/or receiving voice signals, respectively. As another example, application circuit 16 may include a modem that encodes data or video signals into a form suitable for modulation by intermediate-frequency circuit 14.

Software defined radio 10 may be any suitable type of radio that implements a portion of its functions using digital logic 20. That is, radio-frequency front end 12, intermediate-frequency circuit 14, analog to digital converter 15, and/or application circuit 16 may be controlled by digital logic 20 to generate electro-magnetic signals having certain operating characteristics, such as carrier frequency, modulation type, message format, and/or transmission system. In other embodiments, software defined radio 10 may have greater or fewer components than described above. For example, software defined radio 10 may not have intermediate-frequency circuit 14 if heterodyning of information signals from application circuit 16 is not needed or desired.

Controller subsystem 18 may include any type of digital logic 20 for controlling operation of radio-frequency front end 12, intermediate-frequency circuit 14, analog to digital converter 15, and application circuit 16. In one embodiment, digital logic 20 includes a computer processor that executes instructions stored in a memory 24. The computer instructions may be executed to perform various tasks used for operation of software defined radio 10.

Memory 24 may store one or more operating mode records 26. Each operating mode record 26 may include one or more operating parameters used by software defined radio 10. Operating parameters of a particular record 26 may be used by digital logic 20 to configure software defined radio 10 to transmit or receive one or more counter-intelligence signals. For example, operating parameters may include a carrier frequency and an output power that when configured by digital logic 20, causes a jamming signal to be emitted by software defined radio 10. Other records 26 may store operating parameters suitable to jam, spoof, and/or eavesdrop on other communication devices using other operating mode records 26 having differing operating parameters.

In one embodiment, multiple operating mode records 26 may be records that are adapted to counteract differing types of perceived threats. A perceived threat may be associated with any communication device that can be used in an illicit manner. For example, a communication device, such as a consumer radio device, may be illicitly configured on an improvised explosive device (IED). Memory 24 may store multiple operating mode records 26 that may be used by radio 10 to counteract electromagnetic signals transmitted and/or received by these illicit communication devices. Examples of communication devices that may be used in an illicit manner may include various consumer radio devices, such as wireless telephones, key fobs, walkie-talkies, citizens band radios, amateur radios, family radio service (FRS) radios, and data communication devices, such as those that communicate wirelessly using a worldwide interoperability for microwave access (WiMAX) or Wi-Fi protocol. Consumer radio devices may also include the communication portion of various appliances, such as garage door openers, or wireless door bells.

Multiple operating mode records 26 may be stored in memory 24 and selectively configured for use on an as needed basis to counteract any perceived threat. In one example scenario, intelligence reports have indicated that a particular known terrorist is planning an attack using a improvised explosive device (IED) and that this terrorist has recently purchased a wireless telephone that operates using a code division multiplexed access (CDMA) network. To counter this threat, the access key of that particular wireless telephone and other operating parameters may be obtained from the manufacturer. Using these operating parameters, a particular record 26 may be stored with operating parameters, that when configured by digital logic 20, implements one or more counter-intelligence signals for use against that particular wireless telephone. Once the operating parameters are stored in operating mode record 26, it may be selected for use at any time. Thus, software defined radio 10 may be configured to implement counter-intelligence signals for specific applications in a relatively quick manner using operating mode records 26.

Figure 2:
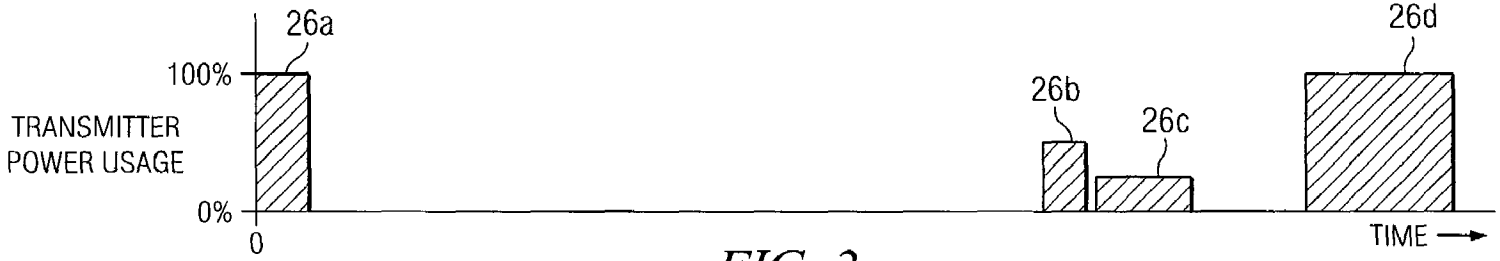
FIG. 2 is a graph showing an example transmitter usage of the communication device of FIG. 1.

FIG. 2 is a graph showing an example transmitter usage of software defined radio 10. In this particular example, the transmitter portion of software defined radio 10 transmits various radio-frequency envelopes 30 over a period of time. In this particular example, radio-frequency envelope 30*a* may be a time division multiplexed signal that may be received by a node configured in a time division multiplex access (TDMA) network used by wireless telephones. Radio-frequency envelopes 30*b* and 30*c* may be a code division multiplexed signal that may be received by a node configured in a spread spectrum network, such as a code division multiplex access (CDMA) network. Radio-frequency envelope 30*d* may include radio-frequency carrier signals modulated with data packets that may be received by nodes of one or more data networks, such as an Ethernet network.

As can be seen in FIG. 2, software defined radio 10 may use only a portion of its information transfer capacity when communicating with other radios. The information transfer capacity of software defined radio 10 may generally refer to its attainable level of information transmission and reception. As shown, envelopes 30 may utilize a portion of the information transfer capacity of software defined radio 10 to communicate with other radios.

Figure 3:
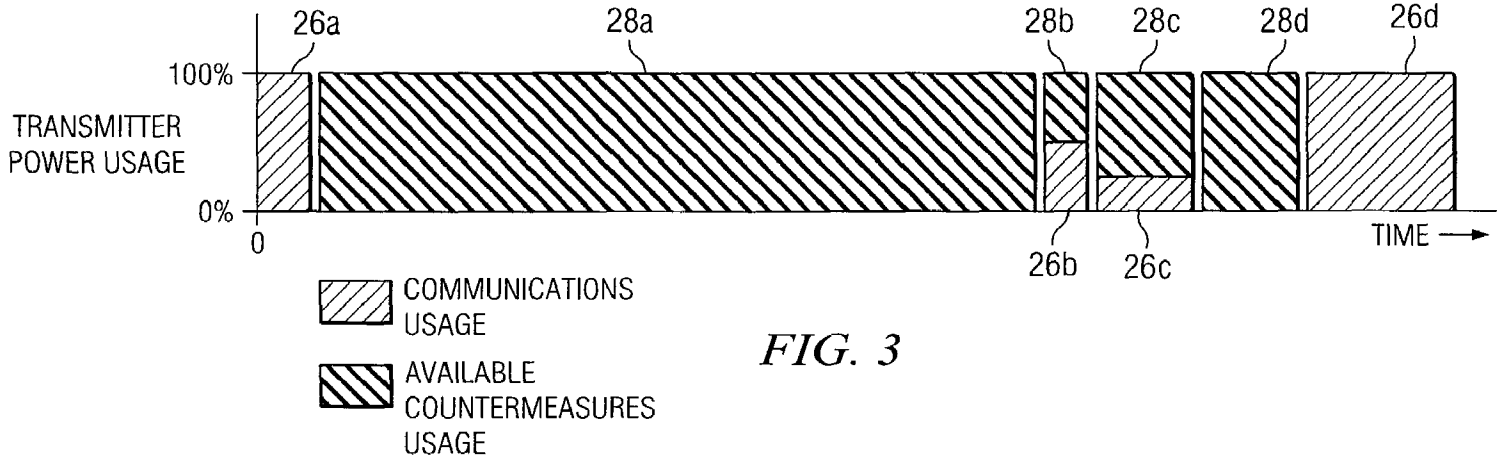
FIG. 3 is a graph showing an example transmitter usage of the communication device of FIG. 1 in which various counter-intelligence signals are transmitted or received using the unused information transfer capacity of the communication device.

FIG. 3 is a graph showing example counter-intelligence signal envelopes 32 that may be multiplexed with radio-frequency envelopes 30 of FIG. 2. Counter-intelligence signal envelopes 32 may be jamming signals or spoofing signals that are transmitted from software defined radio 10. In the particular example shown, counter-intelligence signal envelopes 32 are transmitted in a manner to utilize the unused information transfer capacity of the software defined radio 10. In other examples, either of counter-intelligence signal envelopes 32 may also include a received signal, such as an eavesdropping signal that receives information from another radio. Counter-intelligence signal envelopes 32*a* and 32*d* may be communicated by radio 10 when other radio-frequency envelopes 30 are not simultaneously transmitted. Counter-intelligence signal envelopes 32*b* and 32*c* may utilize the unused information transfer capacity of software defined radio 10 during transmission of radio-frequency envelopes 30*b* and 30*c* using spread spectrum signals.

Figure 4:
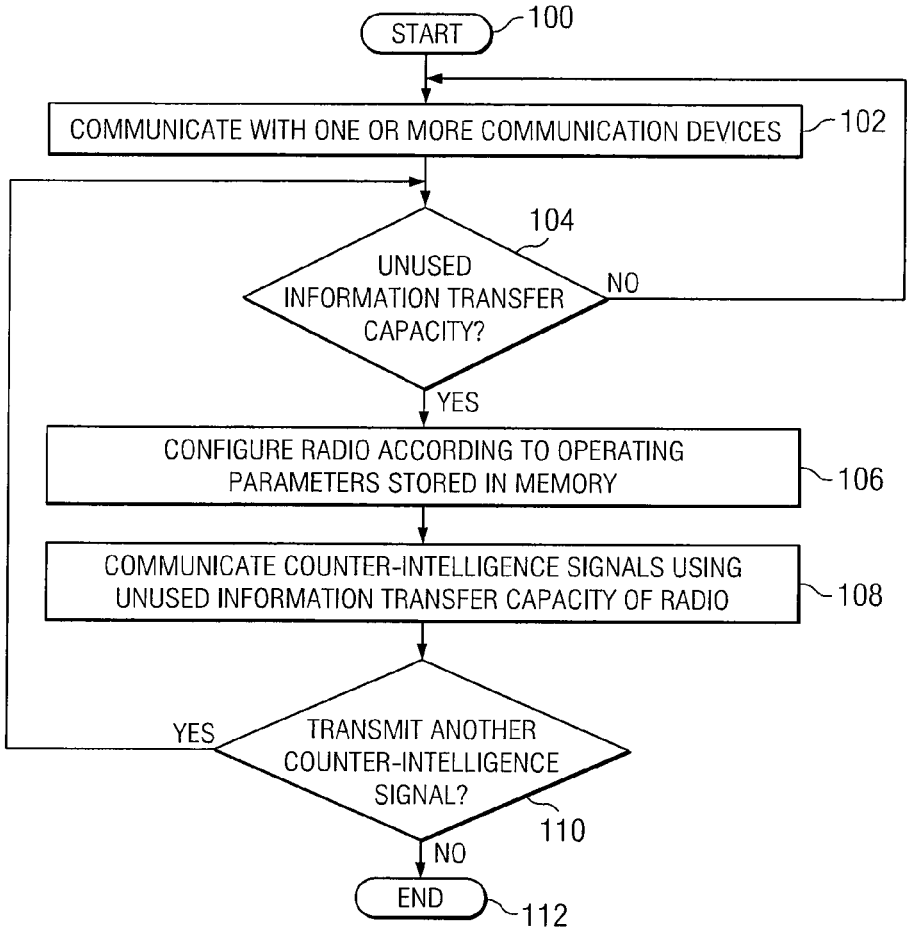
FIG. 4 is a flowchart showing one embodiment of a series of actions that may be performed by the communication device of FIG. 1.

FIG. 4 is a flowchart showing a series of actions that may be performed by controller subsystem 18 to configure the radio 10 to transmit or receive counter-intelligence signal envelopes 32 concurrently with other radio-frequency envelopes 30. In act 100, the process is initiated.

In act 102, controller subsystem 18 configures software defined radio 10 to communicate with another communication device using one or more radio-frequency envelopes 30. The one or more communication devices may comprise any suitable radios or communication nodes that typically communicate with software defined radio 10. Radio-frequency envelopes 30 may include voice, data, and/or video information modulated and/or demodulated from a carrier signal transmitted and/or received by software defined radio 10, respectively. Radio-frequency envelopes 30 may use a portion of the information transfer capacity of software defined radio 10. For example, radio-frequency envelopes 30 may include a time division multiplexed signal comprising multiple envelopes of electromagnetic energy transmitted or received in a periodic manner. The periods of time between transmission or reception of radio-frequency envelopes 30 refers to an unused information transfer capacity of software defined radio 10.

In act 104, controller subsystem 18 may determine whether sufficient unused information transfer capacity exists for transmitting or receiving counter-intelligence signals. If not, software defined radio 10 continues communication with other communication devices in the normal manner. If sufficient unused information transfer capacity exists, however, processing continues at act 106.

In act 106, controller subsystem 18 configures radio 10 to communicate counter-intelligence signals with another communication device. Controller subsystem 18 configures radio 10 using operating parameters stored in one or more operating records 26. Operating mode records 26 may include information for configuring the nature and type of counter-intelligence signal envelopes 32 transmitted or received by software defined radio 10. Thus, operating mode records 26 may provide re-configuration of software defined radio 10 to implement differing types counter-intelligence signals in a relatively quick and efficient manner in some embodiments.

In act 108, controller subsystem 18 causes software defined radio 10 to communicate with the other communication device by transmitting or receiving counter-intelligence signal envelope 32 configured in act 106. That is, counter-intelligence signal envelope 32 may be multiplexed with radio-frequency envelopes 30 using the unused information transfer capacity of software defined radio 10. In one embodiment, a particular counter-intelligence signal envelope 32 is a jamming signal that is configured to overpower other signals received by an enemy's radio. In another embodiment, a counter-intelligence signal envelope 32 is a spoofing signal that is configured to transmit invalid information to another radio. In yet another embodiment, a counter-intelligence signal envelope 32 is a received eavesdropping signal. Any suitable number of counter-intelligence signals may be transmitted or received by software defined radio 10 in which sufficient information transfer capacity is available.

Acts 102 and 108 may continue during operation of software defined radio 10. In act 110, another counter-intelligence signal envelope 32 may be transmitted or received by continuing operation at act 104. That is, multiple counter-intelligence signal envelopes 32 may be transmitted or received by software defined radio 10 if sufficient unused information transfer capacity is available. If, however, operation of radio 10 is no longer needed or desired, the process may be halted in act 112.

Modifications, additions, or omissions may be made to the method without departing from the scope of the disclosure. The method may include more, fewer, or other steps. For example, the method describes reception of counter-intelligence signal envelopes 32 from other radios using an eavesdropping signal. In other embodiments, software defined radio 10 may be configured to trigger an alarm or perform some other suitable action based upon receipt of a particular type of eavesdropping signal received from another radio.

Although the present disclosure has been described in several embodiments, a myriad of changes, variations, alterations, transformations, and modifications may be suggested to one skilled in the art, and it is intended that the present disclosure encompass such changes, variations, alterations, transformations, and modifications as falling within the spirit and scope of the appended claims.

What is claimed is:

1. A software defined radio comprising:

a controller subsystem that controls a plurality of operating parameters of the software defined radio, the controller subsystem comprising a memory storing a plurality of records, each record comprising the plurality of operating parameters, the software defined radio operable to:

configure the software defined radio to communicate with a first communication device using a first electro-magnetic signal, the first electro-magnetic signal using a portion of an information transfer capacity of the software defined radio and being devoid of a counter-intelligence signal; and configure the software defined radio, using one of the plurality of records, to communicate with a second communication device using a second electro-magnetic signal, the second electro-magnetic signal using an unused portion of the information transfer capacity of the radio, the second electro-magnetic signal comprising the counter-intelligence signal selected from the group consisting of a jamming signal, a spoofing signal, and a eavesdropping signal.

2. A radio comprising:

a controller subsystem comprising a memory storing a plurality of records, each record including a plurality of operating parameters of the radio, the controller subsystem operable to:

configure the radio to communicate with a first communication device using a first electro-magnetic signal, the first electro-magnetic signal using a portion of an information transfer capacity of the radio and being devoid of a counter-intelligence signal; and configure the radio, using one of the plurality of records, to communicate with a second communication device using a second electro-magnetic signal, the second electro-magnetic signal using an unused portion of the information transfer capacity of the radio, the second electro-magnetic signal comprising the counter-intelligence signal.

3. The radio of claim 2, wherein the radio is a software defined radio.

4. The radio of claim 2, wherein the controller subsystem is operable to configure the radio, using one of the plurality of records, according to a perceived threat, the plurality of operating parameters of the one record configuring the radio to communicate the counter-intelligence signal with the second communication device that is associated with the perceived threat.

5. The radio of claim 2, wherein the plurality of operating parameters are selected from the group consisting of a carrier frequency, a modulation type, a message format, and a transmission system.

6. The radio of claim 2, wherein the counter-intelligence signal comprises an eavesdropping signal.

7. The communication device of claim 2, wherein the counter-intelligence signal comprises a jamming signal.

8. The radio of claim 2, wherein the counter-intelligence signal comprises a spoofing signal.

9. The radio of claim 2, wherein the radio is operable to combine the first electro-magnetic signal and the second electro-magnetic signal into a multiplexed signal.

10. The radio of claim 9, wherein the multiplexed signal is a time division multiplexed signal.

11. The radio of claim 9, wherein the multiplexed signal is a code division multiplexed signal.

12. The radio of claim 2, wherein the second communication device is a consumer radio device.

13. A method comprising:

communicating, using a radio, with a first communication device using a first electro-magnetic signal, the first electro-magnetic signal using a portion of an information transfer capacity of the radio and being devoid of a counter-intelligence signal; and communicating, using the radio, with a second communication device using a second electro-magnetic signal, the second electro-magnetic signal configured according to one of a plurality of records stored in a memory of the radio, the counter-intelligence signal comprising a plurality of operating parameters describing the second electro-magnetic signal, the second electro-magnetic signal using an unused portion of the information transfer capacity of the radio, the second electro-magnetic signal comprising the counter-intelligence signal.

14. The method of claim 13, wherein the first electro-magnetic signal and the second electro-magnetic signal is transmitted or received using a software defined radio.

15. The method of claim 14, wherein communicating with the second communication device using the second electro-magnetic signal further comprises communicating with the second communication device using the second electro-magnetic signal configured according to a perceived threat, the plurality of operating parameters of the one record configuring the radio to communicate the counter-intelligence signal with the second communication device that is associated with the perceived threat.

16. The method of claim 15, wherein the operating parameters are selected from the group consisting of a carrier frequency, a modulation type, a message format, and a transmission system.

17. The method of claim 13, wherein communicating with the second communication device using the second electro-magnetic signal further comprises communicating with the second communication device using an eavesdropping signal.

18. The method of claim 13, wherein communicating with the second communication device using the second electro-magnetic signal further comprises communicating with the second communication device using an jamming signal.

19. The method of claim 13, wherein communicating with the second communication device using the second electro-magnetic signal further comprises communicating with the second communication device using an spoofing signal.

20. The method of claim 13, further comprising combining the first electro-magnetic signal and the second electro-magnetic signal into a multiplexed signal.

* * * * *